US008803789B2

(12) United States Patent
Keller

(10) Patent No.: US 8,803,789 B2
(45) Date of Patent: Aug. 12, 2014

(54) DISPLAY HAVING LOW ENERGY CONSUMPTION MODE

(75) Inventor: Anton Werner Keller, Arni (CH)

(73) Assignee: Thomson Licensing, Boulogne-Billancourt (FR)

( * ) Notice: Subject to any disclaimer, the term of this patent is extended or adjusted under 35 U.S.C. 154(b) by 264 days.

(21) Appl. No.: 13/146,541

(22) PCT Filed: Jan. 29, 2009

(86) PCT No.: PCT/IB2009/000152

§ 371 (c)(1),
(2), (4) Date: Jul. 27, 2011

(87) PCT Pub. No.: WO2010/086682

PCT Pub. Date: Aug. 5, 2010

(65) Prior Publication Data

US 2011/0310299 A1 Dec. 22, 2011

(51) Int. Cl.

| | |
|---|---|
| ***G09G 3/36*** | (2006.01) |
| ***G09G 3/34*** | (2006.01) |
| ***G09G 5/36*** | (2006.01) |
| ***G09G 5/397*** | (2006.01) |
| ***G09G 3/12*** | (2006.01) |
| ***G09G 3/30*** | (2006.01) |

(52) U.S. Cl.
USPC ..... 345/102; 345/109; 345/545; 345/546; 345/36; 345/45; 345/76

(58) Field of Classification Search
CPC ..... G09G 2320/0646; G09G 2360/16; G09G 2340/125; G09G 5/14; G09G 5/363; G09G 3/12; G09G 3/3233; G02B 6/353; G01R 13/405; H05B 33/08
USPC ..... 345/102, 109, 952, 545, 546, 36, 45, 76
See application file for complete search history.

(56) References Cited

U.S. PATENT DOCUMENTS

| | | | | |
|---|---|---|---|---|
| 2003/0052903 | A1 | 3/2003 | Weast | |
| 2008/0252590 | A1 * | 10/2008 | Doi | 345/102 |
| 2010/0231814 | A1 * | 9/2010 | Yamada et al. | 348/792 |

FOREIGN PATENT DOCUMENTS

| | | | |
|---|---|---|---|
| CN | 101286305 | | 10/2008 |
| EP | 1 653 435 | A1 | 3/2006 |
| WO | WO 2008/029536 | * | 3/2008 |

OTHER PUBLICATIONS

Search Report Dated July 3, 2009.

* cited by examiner

*Primary Examiner* — Aneeta Yodichkas
(74) *Attorney, Agent, or Firm* — Richard LaPeruta; Robert D. Shedd

(57) ABSTRACT

A display comprises a front-end component having light shutters and a plurality of backlight devices, wherein the display operates in a full screen video display mode and partial screen energy-saving auxiliary mode. In the full screen video display mode, the backlight devices are activated and in the partial screen energy-saving auxiliary mode, at least one backlight device is not activated. In the auxiliary mode, the light shutters can control luminance or the light shutters along with attenuating the backlight device control luminance. In the auxiliary mode, the backlight devices are driven via enabled inputs, a digital bus system, or an analog control signal.

10 Claims, 4 Drawing Sheets

DISPLAY HAVING LOW ENERGY CONSUMPTION MODE

This application claims the benefit, under 35 U.S.C. §365 of International Application PCT/IB09/00152, filed 29 Jan. 2009, which was published in accordance with PCT Article 21(2) on 5 Aug. 2010 in English.

FIELD OF INVENTION

The invention relates to display device that presents images associated with auxiliary devices.

BACKGROUND OF THE INVENTION

Liquid crystal displays (LCDs) of today commonly utilize a plurality cold cathode florescent light lamps to backlight the LCD panel with white light. An LCD front-end panel has a series of pixels which are further divided into red, green, and blue (R,G,B) sub-pixels, wherein each sub-pixel is equipped with a corresponding color filter. The common operation of LCDs is to have each of the lamps illuminate during the showing of each frame of video during the presentation of images on the display.

With large liquid crystal displays becoming more popular among consumers as their principal display devices, such displays are likely becoming one of the more visible and prominent features in consumer homes.

On the other hand, the audio industry has continuously been making audio devices such as radios, MP3 players and iPODs smaller, more portable and technologically more powerful. In light of the portable nature and/or technological prowess of such devices, these devices can become more interactive with other devices which could also include display devices such as LCDs.

In light of the above, it is contemplated that a future need exists for an LCD display that operates basically in the same manner as today's LCDs, but can also operate in an energy saving mode when auxiliary equipment is coupled to an LCD and when the consumer wishes to take advantage of or experience the auxiliary equipment through the LCD display.

SUMMARY OF THE INVENTION

The invention is a display system that reduces power consumption while the display system displays image banners associated with and/or produced by an auxiliary device when coupled to the display system such as a radio, audio music players or the like.

The display system comprises a front-end component having light shutters and a plurality of backlight devices, wherein the display operates in a full screen video display mode and partial screen energy-saving auxiliary mode. In the full screen video display mode, the backlight devices are activated or turned on and in the partial screen energy-saving auxiliary mode at least one backlight device is not activated or turned on. In the auxiliary mode, the light shutters can control luminance or the light shutters along with backlight device control luminance. In the auxiliary mode, the backlight devices can be driven via enabled inputs or a digital bus system.

The display is operated by a method comprising the steps of selecting an auxiliary mode having video frames with partial screen content and activating less than all backlight elements during the video frames. The method includes presenting a banner in the auxiliary mode and can further include coupling an auxiliary device to the display to present a banner.

The auxiliary device can be a radio or a set-top box and can display an information or entertainment banner from the radio or set-top box.

DETAILED DESCRIPTION OF THE PREFERRED EMBODIMENTS

Figure 1A:
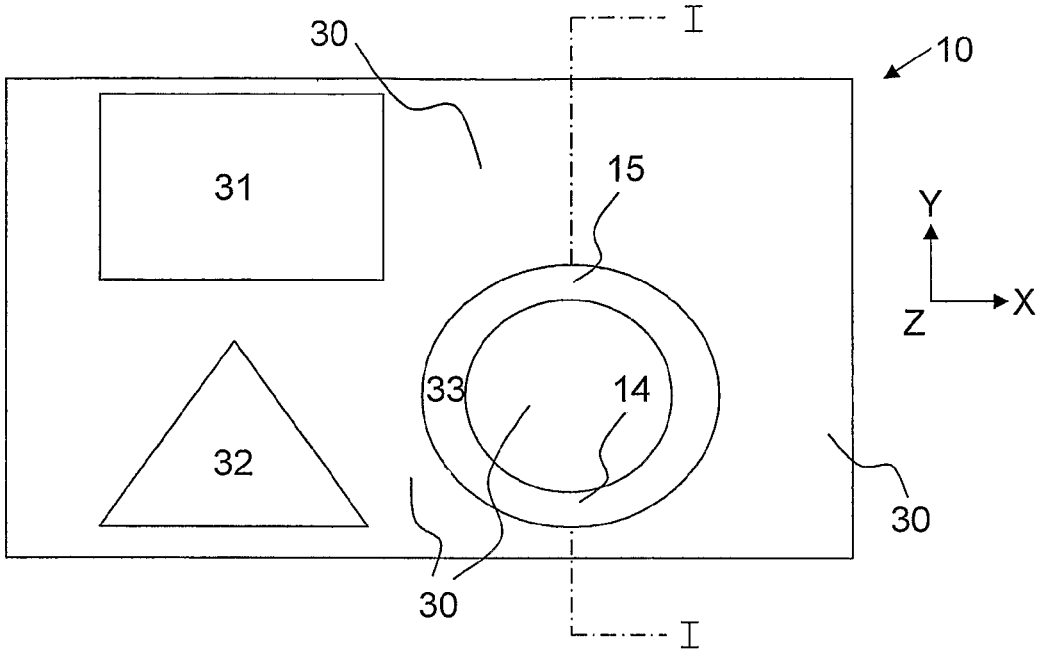
FIG. 1A is a front view of a liquid crystal display (LCD) according to the invention when the display is operating in a full screen video display mode.
Figure 1B:
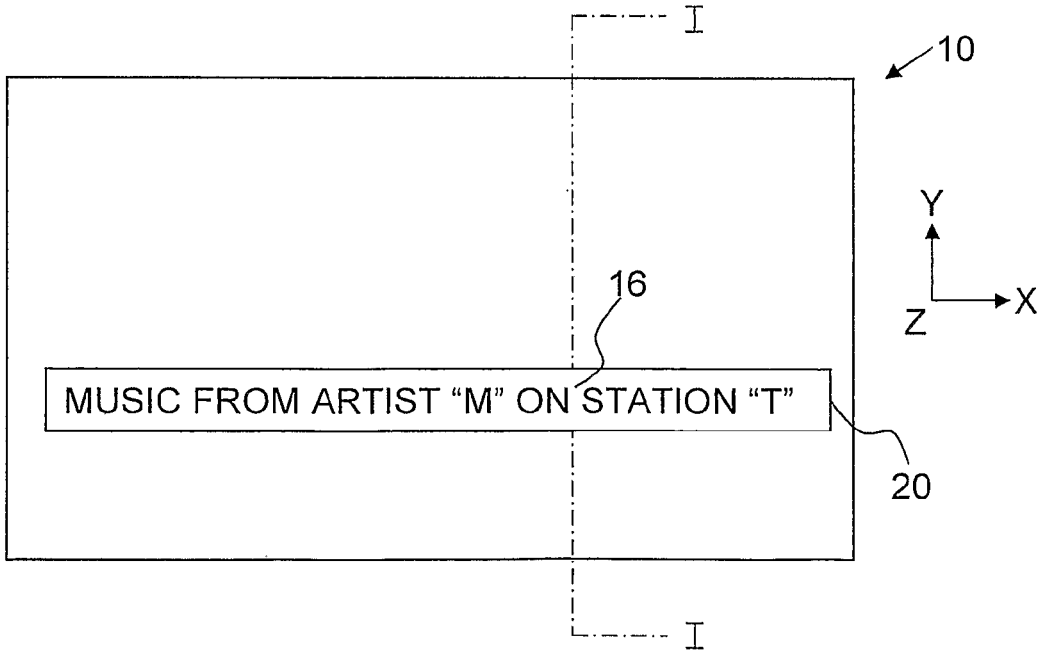
FIG. 1B is a front view of the liquid crystal display (LCD) according to the invention when the display is operating in a partial screen video display mode.

FIGS. 1A and 1B are front views of a liquid crystal display (LCD) 10 according to the invention. FIGS. 1A and 1B show that the display is designed to operate in two separate modes. FIG. 1A is an example of the display 10 when it is operating in a full screen video display mode and FIG. 1B is an example of the display 10 operating in an auxiliary display mode, which can be described as partial screen video display mode, energy saving mode or banner mode.

More particularly, the full video display mode of FIG. 1A is a mode in which the display is ready to exhibit color images throughout the entire screen from one frame to the next frame. Here the full video display mode can be the presentation of a typical television broadcast.

Figure 2A:
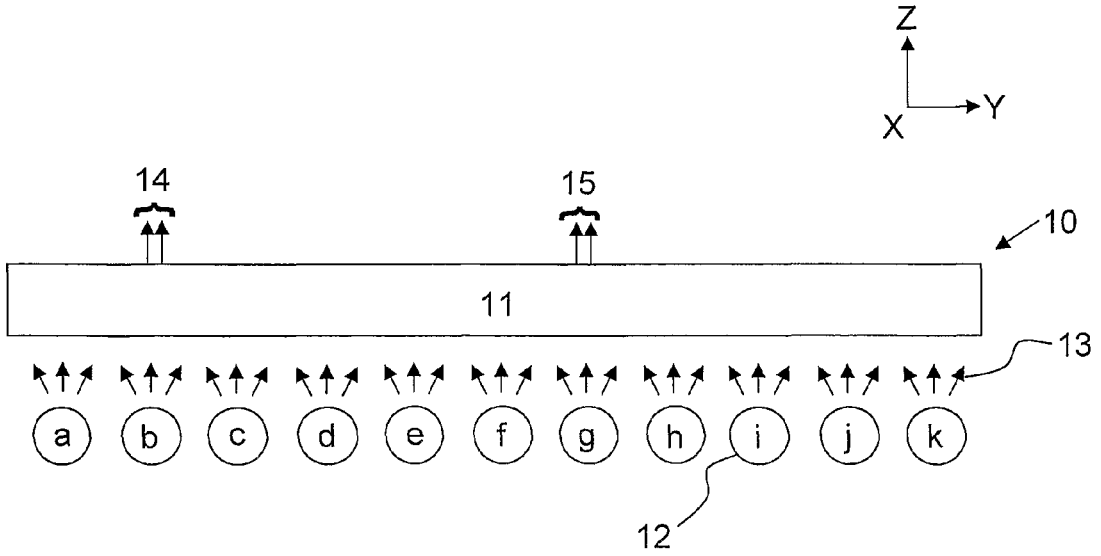
FIG. 2A is a section view of a liquid crystal display (LCD) according to the invention when the display is operating in a full screen video display mode.

FIG. 2A is a section view of a liquid crystal display 10 during full screen video display mode. FIG. 2A is a section view along cross-section I-I in FIG. 1A. FIG. 2A shows that during any video frame in a full screen video display mode each of the backlight lamps 12 are on for some period of time. The backlight lamps are labeled lamp a through lamp k and these lamps illuminate backlight 13 toward the liquid crystal front-end 11 during each video frame. The backlight lamps 12 can be cylindrically shaped lamps that are oriented parallel with the horizontal axis X. The front-end 11 includes the individual liquid crystal cells (not shown) which act as light shutters or valves to appropriately attenuate the backlight 13 such that only the intended visible image light 14, 15 is observed by the viewer as it propagates away from the front-end 11, preferably parallel to the Z-axis on average, and generally toward the viewer. In the current example, only image light 14 from lamp b and image light 15 from lamp g are shown for the particular frame of view shown in FIG. 1A, because the liquid crystal pixels in the regions near the lamp b and lamp g, respectively, are permitting the backlight 13 to propagate through the liquid crystal cells and toward the viewer. Specifically, the video frame in FIG. 1A includes the presentation of an illuminated rectangle 31, an illuminate triangle 32, and an illuminated ring 33. In this example the illuminated ring 33 has a dark or black center. The shaded areas 30 represent black fields in which the liquid crystal cells are operating to attenuate the backlighting incident on them.

As mentioned above, FIG. 1B is an example of the display 10 operating in an auxiliary mode. This auxiliary mode can be utilized when the display is coupled to an auxiliary device such as radio, audio music players, set-top box or the like. This auxiliary mode can also be referred to as an audio, radio or information mode. In fact, the display can be adapted such that it can switch to the auxiliary mode at the request of an external device by remote command via a media streamer, local area network, an audio device, or portable media players such as iPODs.

In the auxiliary mode, the lamps of the unused areas will be turned off. This invention matches all applications where only a banner type of display is used. Here, energy can be saved by increasing the efficiency of the lamps and their matching power supplies. This mode is particularly beneficial for audio modes that involve listening to radio stations or audio input through servers. A banner 20 containing the radio data can be displayed in a small field or textbox. The displayed information could be the radio station, title, name of a musician or the length of play. In this example, only one lamp is on during each frame.

Figure 2B:
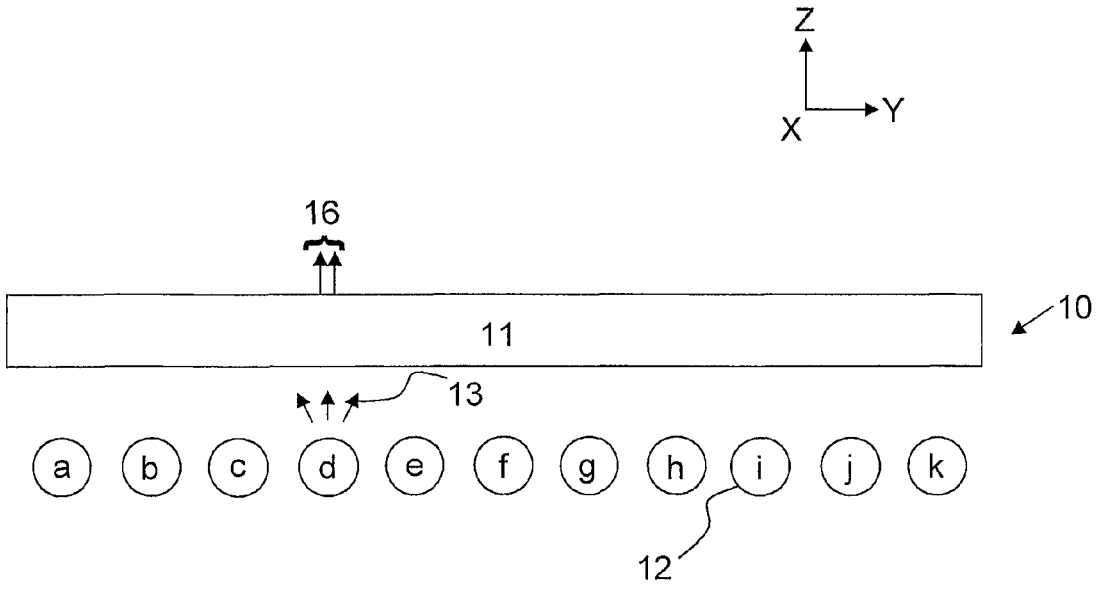
FIG. 2B is a section view of the liquid crystal display (LCD) according to the invention when the display is operating in a partial screen video display mode.

FIG. 2B is a section view the same liquid crystal display (LCD) 10 shown in FIG. 1B along cross-section I-I, wherein the display is operating in a second mode, i.e., auxiliary mode, and preferably when the display is coupled to an auxiliary device and full screen presentation of video is not necessary or desired. Here, FIG. 2B shows that during each frame of video only a limited number of lamps are emitting backlight 13. In this particular case, only lamp d is illuminating backlight 13 toward the liquid crystal front-end 11 during each video frame which corresponds to visible banner light 16.

The invention is particularly useful because of the growth of digital satellite channels (which transmit audio files), internet-radio, and digital audio broadcast (DAB) or the connection to so-called media streamers which can be included in a TV receiver and can be well suited for the operation of a banner mode. With the use of the invention, considerable energy can be saved. One exemplary measurement showed that 85 W of a total consumption of 125 Watt are used for backlighting in operating a 26 inch LCD screen display. When the display is operated in banner mode 80-90% of lighting energy can be saved. During the banner mode a remarkable amount of energy could be saved. The reduction could be up to 100 W.

A further possibility for the banner mode can be information derived from the information streams, such as weather or public broadcast alerts that can be tied to set-top boxes, or simple programmed information that can be displayed in banner mode when conventional television is not operating and the set-top box or the like is in a standby mode. Alternatively, a place-holder with channel information or the time could be displayed in a banner mode.

It should be pointed out that although only lamps a through k are shown, the display according to the invention can include more or less lamps and also backlight 13 from more than one lamp can be incident on any one liquid crystal cell. The backlighting can be constructed with 4-30 fluorescent lamps that can run pair-wise (serial connection) on respective inverters.

Figure 3:
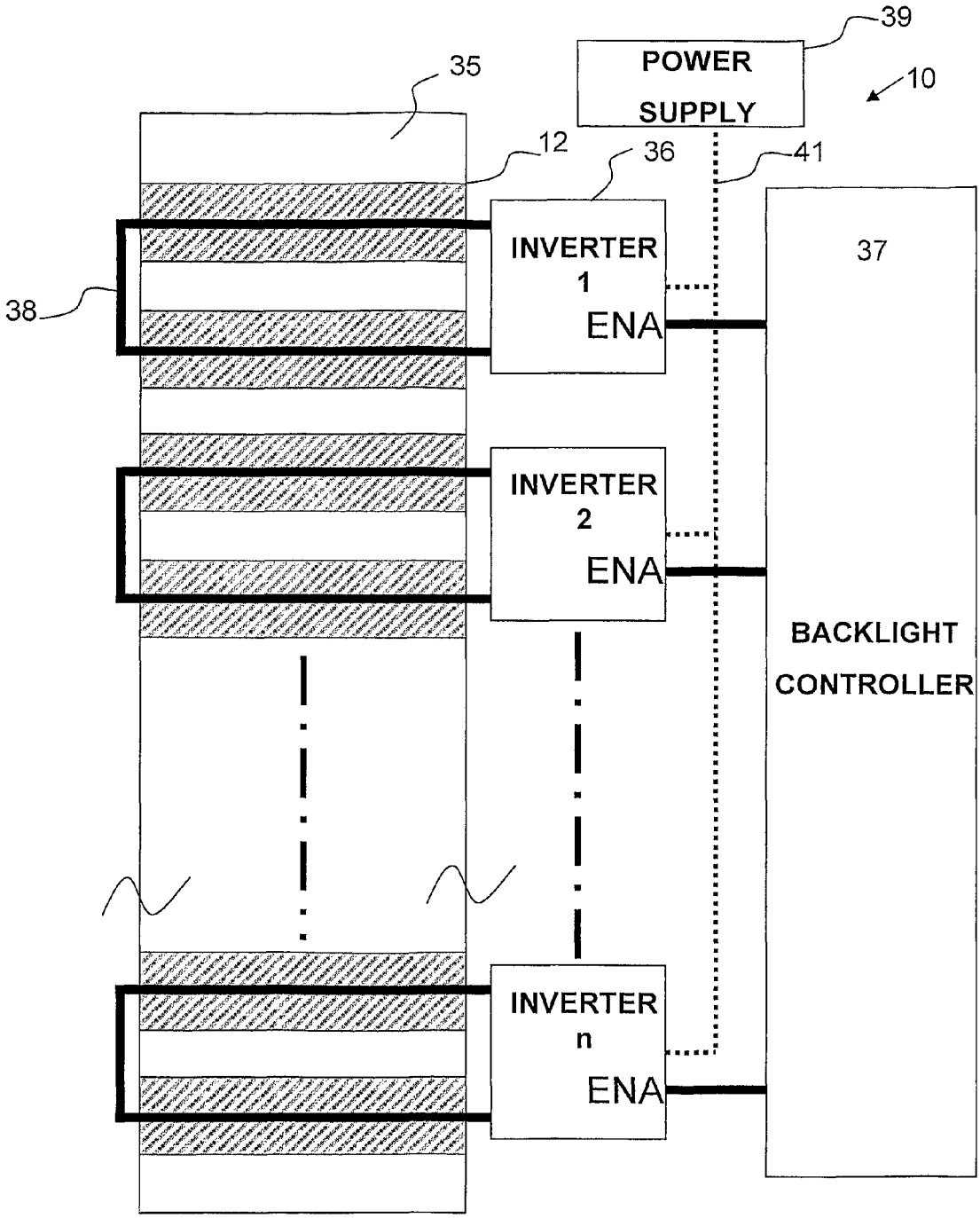
FIG. 3 shows a lamp and driver arrangement for the display according to one embodiment of the invention.

FIG. 3 shows a lamp and driver arrangement according to the invention. In this arrangement inverters 36, labeled 1, . . . n, drive the backlight lamps 12 through electrical connections 38 when the backlight controller 37 signals the inverter to drive the backlight lamps 12, wherein for this particular example one inverter services two lamps. Having the two lamps in series reduces the number of inverters needs. However, each lamp can have its own inverted. The power supply 39 provides the electrical power to the inverters 36 to drive the backlight lamps through electrical wires 41. FIG. 3 shows the screen 35, which receives light from the backlight lamps 12. When the display 10 is in a full screen video display mode each of the backlight lamps 12 are activates and in a partial screen video display mode or banner mode only backlight lamps from the relevant areas are active during each frame. In this embodiment, the backlight lamps are intended to operate at constant intensity during a frame and the brightness of the display is attenuated by the light values or liquid crystal cells in the front-end. In this embodiment, inverters are turned on and off individually via enable input, which is shown by the symbol ENA in FIG. 3.

Figure 4:
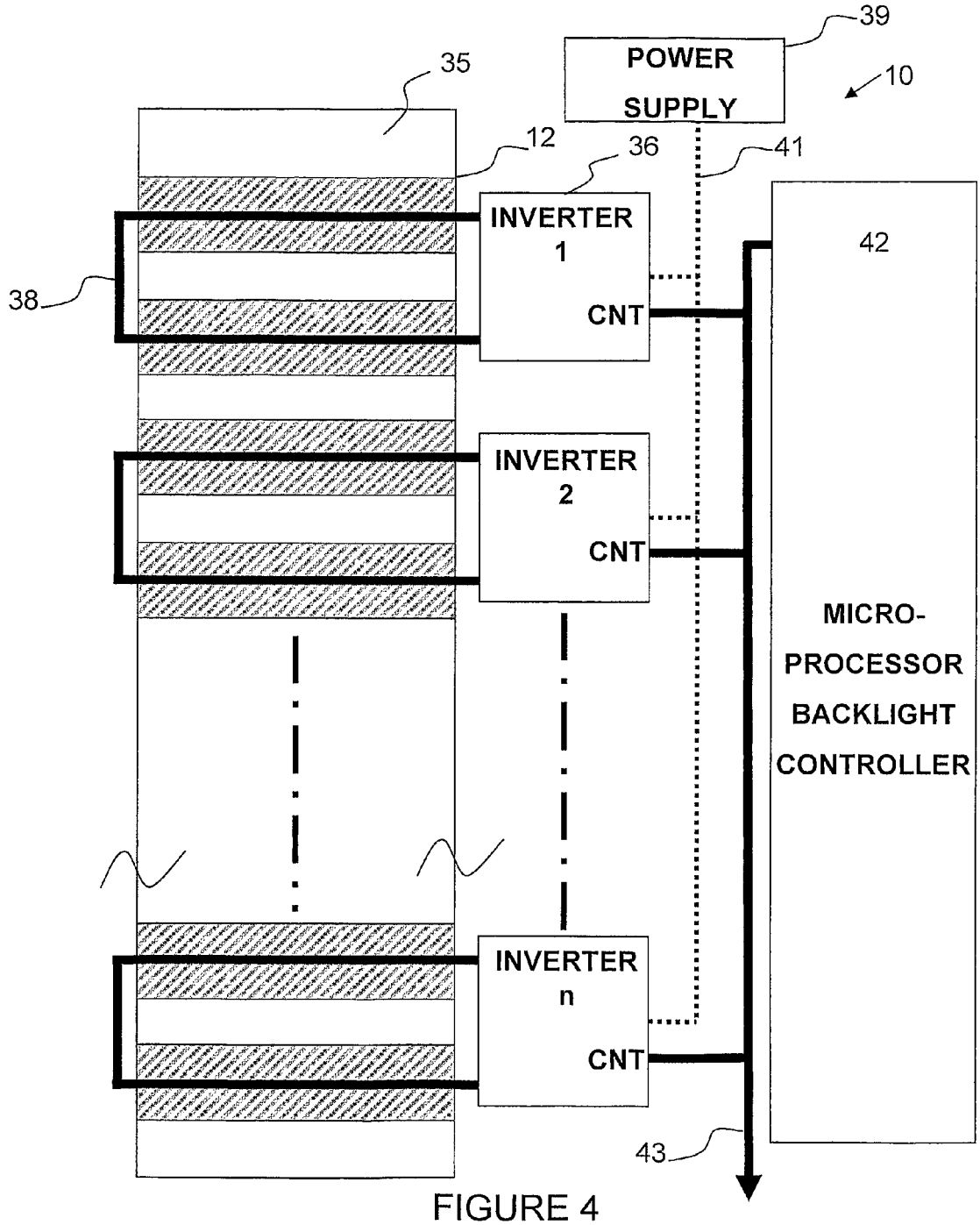
FIG. 4 shows another lamp and driver arrangement for the display according to another embodiment of the invention.

FIG. 4 shows an alternative embodiment, wherein the backlighting is individually controlled via analog control signals or a digital bus system such as a $I^2C$ bus. In this arrangement, the inverters 36, labeled 1, . . . n, drive the backlight lamps 12 through electrical connections 38 when the microprocessor backlight controller 42 signals the inverters through electrical bus 43 to drive the backlight lamps 12, which is represented by CNT in FIG. 4. The power supply 39 provides the electrical power to the inverters 36 to drive the backlight lamps through electrical wires 41. FIG. 4 also shows the screen 35, which receives light from the backlight lamps 12. When the display 10 is in a full screen video display mode each of the backlight lamps 12 are activated and in a partial screen video display mode or banner mode only backlight lamps from relevant areas are active during each frame. In this embodiment, intensity of the backlight are variable such that when a frame requires greater intensity the backlights are driven to produce more light and when a frame requires less intensity the backlights are driven to produce less light. In other words, the backlight lamps 12 are run to partially dim or attenuate the light. In this embodiment, it is important to point out that the light shutters or liquid crystal cells still attenuate light in order to appropriately control the local brightness from pixel to pixel and control the required luminance differences between the individual colored subpixels within a give pixel. In this current embodiment, further energy savings are realized in the banner mode. It should be pointed out that in this embodiment there is a further opportunity to save energy in that if only a banner is shown in a small area of the display screen while the remainder of the display is a black field, there is a significant perceived contrast between the banner and the rest of the display; as such, the banner can be run with lower luminance than if there were surrounding colored fields, because of the contrast and/or dark view adjustment of the viewer eyes.

It should be pointed out that the invention can include in all of the embodiments having two ore more such banners displayed with only their respective backlight lamp and/or backlight lamps on. Further, the two or more banners can be associated with one auxiliary device or two or more auxiliary devices.

The invention is also applicable to displays in which light emitting diodes (LEDs) or field emission devices provide backlight to liquid crystal front-end or other light shutter/valve front-ends.

To prevent non-uniform ageing of the lighting device in the limited illuminated display area in the banner mode, the banner can be programmably controlled to move gradually around the screen. This change could be a gradual motion up and down or a random repositioning.

Also, during the banner mode more than one backlight can be activated for purposes of light uniformity.

Regarding light uniformity, it is important to point out that during the operation in full video display mode there are significant advantages in operating all backlight lamps in LCD displays. One advantage is that using all lamps provides and ensures light uniformity and another is that operating all of the lamps ensures that the lamps all age equally.

Although each of the examples shows that the backlights 12 extend across the entire screen, the invention also includes examples where there is a plurality of backlights 12 aligned end-to-end along horizontal lines. As such, examples include situations in the banner mode, wherein not all of the backlight lamps 12 in a given horizontal line are activated. This is particularly beneficial in the case where the banners do not to need extend across the screen.

Although the invention is illustrated and described herein with reference to specific embodiments, the invention is not intended to be limited to the details shown. Rather, various modifications may be made in the details within the scope and range of equivalents of the claims and without departing from the invention.

The invention claimed is:

1. A display comprising:

a front-end component having light shutters;

a screen;

a full screen display mode and a partial screen display mode, wherein the full screen display mode corresponds to a television broadcast and the partial screen mode corresponds to images associated with the external auxiliary device; and a plurality of backlight devices, wherein each backlight device is activated during frames in the full screen video display mode such that the entire screen is backlit;

at least one backlight device not being activated in the partial screen mode such that only a portion of said screen is backlit during a frame in the partial screen mode and the display displays information in a banner format in the partial screen mode.

2. The display of claim 1, wherein the light shutters control luminance in the auxiliary mode.

3. The display of claim 2, wherein the backlight intensity attenuates to partially control luminance in the partial screen mode mode.

4. The display of claim 1, wherein inverters drive the backlight devices.

5. The display of claim 4, wherein the inverters are turned on and off individually via enable inputs.

6. The display of claim 4, wherein the inverters are controlled by analog control signals.

7. The display of claim 4, wherein the inverters are controlled by digital bus system.

8. The display of claim 1, wherein the partial screen mode mode is an audio mode, radio mode or an information mode.

9. The display of claim 1, wherein the display is adapted to switch to partial screen mode mode by a remote command via a media streamer, local area network, an audio device, or portable media players.

10. A method of displaying images on a screen of a display coupled to an external auxiliary device , comprising the steps of:

determining whether an input signal to the display requires a full screen display mode or a partial screen display mode, wherein the full screen display mode corresponds to a television broadcast and the partial screen display mode corresponds to images produced by the external auxiliary device;

backlighting all of said screen during said full screen display mode;

coupling to the display to the external auxiliary device; and backlighting only a portion of said screen during said partial screen display mode during a frame; and displaying information in a banner format during said step of backlighting only said portion of said screen.

* * * * *